US005299542A

United States Patent [19]

Hafner

[11] Patent Number: 5,299,542

[45] Date of Patent: Apr. 5, 1994

[54] FUEL DISTRIBUTOR

[75] Inventor: Udo Hafner, Ludwigsburg, Fed. Rep. of Germany

[73] Assignee: Robert Bosch GmbH, Stuttgart, Fed. Rep. of Germany

[21] Appl. No.: 39,192

[22] PCT Filed: Jul. 29, 1992

[86] PCT No.: PCT/DE92/00619

§ 371 Date: Apr. 14, 1993

§ 102(e) Date: Apr. 14, 1993

[87] PCT Pub. No.: WO93/04276

PCT Pub. Date: Mar. 4, 1993

[30] Foreign Application Priority Data

Aug. 24, 1991 [DE] Fed. Rep. of Germany ..... 4128086

[51] Int. Cl.[5] ..... F02M 55/02; F02M 61/14; F02M 69/46

[52] U.S. Cl. ..... 123/470; 123/468

[58] Field of Search ..... 123/456, 468, 470, 469, 123/472

[56] References Cited

U.S. PATENT DOCUMENTS

| | | | |
|---|---|---|---|
| 4,474,160 | 10/1984 | Gartner | 123/470 |
| 4,751,904 | 6/1988 | Hudson, Jr. | 123/456 |
| 4,836,246 | 6/1989 | Lemp . | |
| 4,844,036 | 7/1989 | Bassler et al. | 123/470 |
| 4,922,958 | 5/1990 | Lemp | 123/456 |
| 4,955,409 | 9/1990 | Tokuda et al. | 123/456 |
| 5,016,594 | 5/1991 | Hafner et al. | 123/456 |
| 5,058,555 | 10/1991 | Haboush, II et al. | 123/456 |
| 5,226,391 | 7/1993 | Gras et al. | 123/456 |

FOREIGN PATENT DOCUMENTS

| | | |
|---|---|---|
| 3326408 | 2/1984 | Fed. Rep. of Germany . |
| 64-32065 | 2/1989 | Japan . |
| WO9013741 | 11/1990 | PCT Int'l Appl. . |

*Primary Examiner*—E. Rollins Cross
*Assistant Examiner*—Thomas Moulis
*Attorney, Agent, or Firm*—Edwin E. Greigg; Ronald E. Greigg

[57] ABSTRACT

A fuel distributor which has a valve acceptance opening for fuel injection valves which are in connection with a main flow conduit. The fuel distributor is easily manufactured from a profiled semi-finished product and has a fuel volume, free of vapor bubbles, located around the fuel injection valve. During a hot start of the internal combustion engine, this fuel volume permits fuel which is free from bubbles and permits a good ignitability to be sprayed through the fuel injection valves. The fuel distributor according to the invention is particularly suitable for fuel injection systems of mixture-compressing spark-ignition internal combustion engines.

15 Claims, 3 Drawing Sheets

FUEL DISTRIBUTOR

STATE OF THE ART

The invention is based on a fuel distributor for a fuel injection engine. A fuel distributor for an internal combustion engine is already known from DE 37 30 571 A1 which uses a plurality of fuel injection valves for the fuel supply. The number of valves, corresponding to the number of through valve acceptance features in a valve carrier. The valves are electromagnetically actuable fuel injection valves being axially insertable into the valve acceptance features, and has a supply conduit open towards the valve acceptance features.

The fuel injection valves are fixed on the valve carrier by means of a contract strip which passes over, in bonnet-shape, the part of the injection valves protruding from the valve acceptance feature and hooks by means of engagement lugs into corresponding engagement recesses in the valve carrier. The injection valves are fixed in the axial and peripheral directions by this contact strip, which acts simultaneously to provide the electrical contact for the injection valves.

Tolerance problems between electrical plug pins on the injection valve and electrical plug pin acceptance features in the contact strip can, however, cause certain rotations of the injection valves during assembly so that the injection valves do not maintain their specified direction in the valve acceptance features and, in consequence, their jet direction is altered in an undesired manner.

Furthermore, starting difficulties in the internal combustion engine can occur during a hot start of an internal combustion engine equipped with a fuel distributor of this type due to the formation of fuel vapour bubbles if, during the first few seconds after starting, fuel mixed with vapour bubbles is injected. The fuel vapour bubbles occur due to the strong thermal effect of the internal combustion engine, which has been heated in operation, on the devices carrying the fuel. The cause of the starting difficulties is the severe weakening of the fuel-/air mixture formed and, therefore, an unwillingness to ignite.

ADVANTAGES OF THE INVENTION

The fuel distributor according to the invention has an advantage that the injection of fuel free from vapour bubbles by the fuel injection valves is ensured, even in the first few seconds after a hot start of the internal combustion engine, by the formation of an adequate reservoir with fuel free from vapour bubbles. The fuel-/air mixture formed in this way has good ignitability.

In the case of a fuel distributor consisting of a single flow passage, good cooling is achieved by fuel flow on all sides around the valve acceptance feature and the formation of vapour bubbles is avoided. The fuel volume free from vapour bubbles within the valve acceptance feature must be protected from mixing with fuel mixed with vapour bubbles. This is achieved by an arrangement of at least one fuel supply opening on a side of the valve acceptance feature which is not directed against the flow direction, for example one at right angles to the flow direction or facing away from the flow direction.

The fuel distributor according to the invention has one advantage that it can be manufactured in a simple and low-cost manner and permits a large fuel volume free from vapour bubbles. Furthermore, the fuel located in the outer annular gap is cooled by the fuel flowing through the fuel supply passage so that vapour bubble formation is prevented in the outer annular gap.

Advantageous further developments and improvements to the fuel distributor are possible by means of the measures listed hereinafter. It is advantageous to fasten the fuel injection valve on the valve acceptance feature of the fuel distributor by means of a clip, which represents a particularly low-cost fastening. Fastening the fuel injection valve on the fuel distributor by means of a bayonet fastening permits rapid assembly and fixing in an accurately specified rotational position.

DRAWING

Embodiment examples of the invention are shown simplified in the drawing and are explained in more detail in the following description.

FIG. 1 shows an excerpt from a fuel distributor according to the invention and in accordance with a first embodiment example, FIG. 2 shows a plan view onto the fuel distributor, FIG. 3 shows an excerpt from a second embodiment example of a fuel distributor according to the invention, FIG. 4 shows a plan view onto the fuel distributor of the embodiment shown in FIG. 3 and FIG. 5 shows a sheet-metal part configured as a bayonet socket.

DESCRIPTION OF THE EMBODIMENT EXAMPLES

Figure 1:
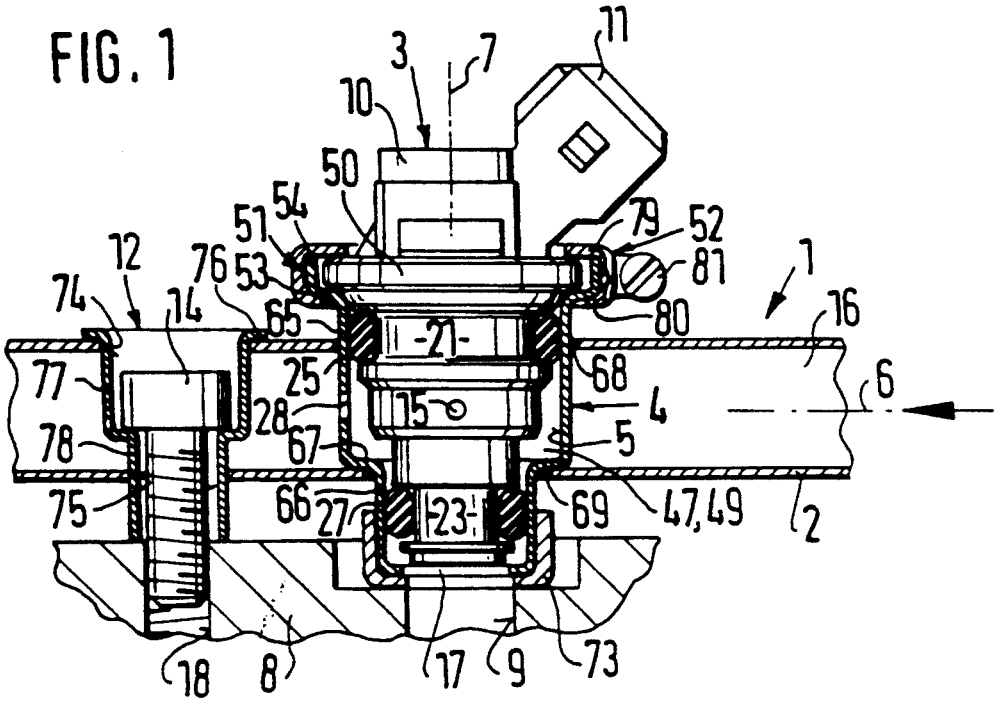

The fuel distributor 1, shown in the drawing as an example and only as an excerpt, for fuel injection systems of mixture-compressing spark-ignition internal combustion engines are shown connected to a fuel supply conduit, not shown in any more detail.

Figure 2:
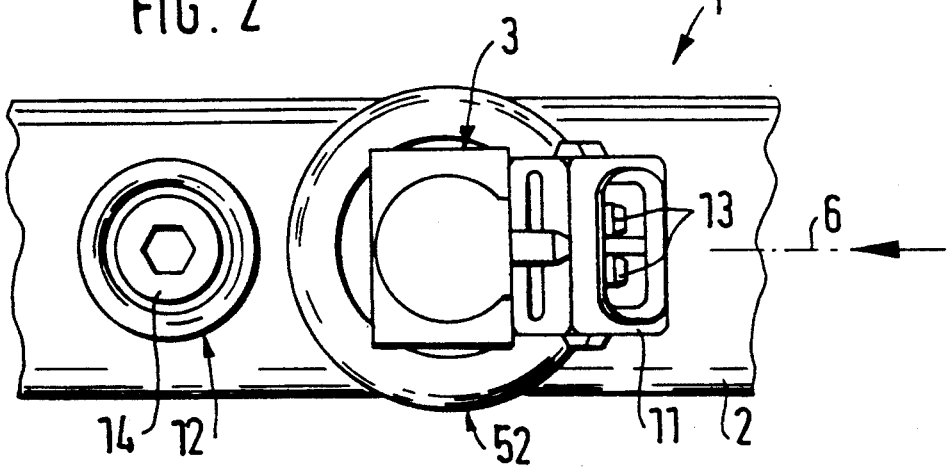

A tubular fuel supply passage 2, having for example a rectangular cross-section and having a flow cross-section 16, of the fuel distributor 1 of FIGS. 1 and 2 is used to supply fuel to at least two fuel injection valves 3. The fuel supply passage 2 has, along a longitudinal axis 6 of the distributor, a number, corresponding to the number of fuel injection valves 3, of stepped valve acceptance features 4 which pass through the fuel supply passage 2 and accept the fuel injection valves 3. Each of the valve acceptance features 4 has a valve acceptance opening 5 into which a fuel injection valve 3 can be inserted in such a way that the walls of the valve acceptance features 4 at least partially surround, at a radial distance, the fuel injection valves 3 in the direction of an acceptance feature longitudinal axis 7.

The fuel injection distributor 1 is, for example, arranged on an induction pipe 8 of an internal combustion engine in such a way that the fuel injection valves 3 inserted in the fuel distributor 1 eject the fuel into induction pipe passages 9 of the induction pipe 8, for example directly in front of inlet valves (not shown) of the internal combustion engine.

The fastening of the fuel distributor 1, for example on the induction pipe 8, takes place, for example, by means of at least one stepped-down, tubular screw acceptance feature 12, which penetrates the fuel supply passage 2 in two coaxial holes 74, 75 and is inserted in a sealed manner into these holes by, for example, soldering, brazing or welding. The screw acceptance feature 12 has a first cylindrical section 77 which is followed by a second cylindrical section 78 of smaller diameter on the end facing towards the induction pipe 8. A step 76 extending radially outwards is formed on the end 74 of the first cylindrical section facing away from the induction pipe 8, which step 76 is supported on the outside of the wall of the fuel supply passage 2 and fixes the axial position of the screw acceptance feature 12. A corresponding screw 14 is inserted in the screw acceptance feature 12 and this screw 14 interacts with a thread 18 which is provided, for example, in the induction pipe 8.

The fuel injection valves 3 shown, as an example, in FIGS. 1, 2, 3 and 4 have, at a connection end 10, an electrical connection plug 11 with, for example, two electrical contact elements 13 and, at their periphery, for example, two fuel supply openings 15. During its actuation, the fuel is ejected from a spray opening 17, facing away from the connection end 10, of the respective fuel injection valve 3.

A known contact plug (not shown in any more detail) is used, for example, to provide the electrical contact between the fuel injection valves 3 and their electrical contact elements 13.

A first annular groove 21 is provided at the periphery of each fuel injection valve 3 above the fuel supply openings 15 and facing towards the connection end 10 and a second annular groove 23 is provided below the fuel supply openings 15 and facing towards the spray opening 17. A first sealing element 25—an O-ring, for example—is arranged in the first annular groove 21 and a second sealing element 27—an O-ring, for example—is arranged in the second annular groove 23. The sealing elements 25, 27 represent a seal between the periphery of the fuel injection valve 3 and the wall of the valve acceptance feature 4 so that fuel supplied to the fuel supply opening 15 of the fuel injection valve 3 is prevented from emerging from the valve acceptance feature 4 at an undesired position.

A reservoir volume 47 surrounding the fuel injection valve 3 is formed in the radial direction between the wall of each valve acceptance feature 4 and the periphery of the respective fuel injection valve 3. This reservoir volume extends in the direction of the acceptance feature longitudinal axis 7 from the first sealing ring 25 to the second sealing ring 27 and it is in connection with the flow cross-section 16 of the fuel supply passage 2 of the fuel distributor 1 via at least one fuel supply opening 28.

The reservoir volume 47 surrounding the fuel injection valve 3 is referred to below as the thick juice reservoir 49. The person skilled in the art refers to the fuel which has been reduced by the lighter volatile constituents, which have appeared as vapour bubbles, as "thick juice". Because this thick juice fuel has an increased boiling point, it is less inclined to form vapour bubbles than fuel of normal consistency. It is only this which permits exact metering of the fuel quantity in liquid form during a hot start because vapour bubbles no longer affect the metering.

The function of the thick juice reservoir 49 is as follows:

After an operationally warm internal combustion engine (equipped with the fuel distributor 1 according to the invention) has been shut down, there is a powerful thermal effect, at the surface of the fuel injection valve 3 and the fuel distributor 1, on the now motionless fuel located in the thick juice reservoir 49. This is because the cooling effects of the air flowing through the engine compartment, of the cooling water circulating in the internal combustion engine and of the fresh fuel scavenging the fuel distributor 1 during operation are lacking. The consequence is heating of the fuel located in the thick juice reservoir 49 and evaporation of the lighter volatile fuel constituents. This vapour bubble formation is further supported by the slowly falling fuel pressure after the internal combustion engine has been shut down. Some time after the operationally warm internal combustion engine has been shut down, all the lighter volatile fuel constituents within the thick juice reservoir 49 have evaporated and the thick juice remains. If a hot start of the internal combustion engine now occurs, it is precisely this liquid thick juice which is sprayed through the fuel injection valve 3 for the first few seconds after the start. This also ensures the readiness to ignite of the fuel/air mixture prepared—even in the case of a hot start. A rational transition from the injection of thick juice to the injection of cool, fresh fuel can be achieved by a suitable choice of the size of the thick juice reservoir 49, i.e. by a choice of the size of the reservoir volume 47.

It is necessary to prevent mixing between the thick juice in the reservoir volume 47 and fuel enriched with vapour bubbles because otherwise the advantageous effect of the thick juice reservoir 49 is lost. In the fuel distributor according to the invention, this is achieved by means of the fuel supply opening(s) 28 through which, substantially, only as much fuel can pass into the thick juice reservoir 49 as is sprayed out by the injection valve 3. It is advantageous for the fuel supply opening 28 not to be arranged on the side of the valve acceptance feature 4 facing towards the flow direction of the fuel (shown in the drawing by an arrow) but on a side at right angles to the flow direction or facing away from the flow direction, for example in such a way that the normal vector of the fuel supply opening is parallel to the flow direction.

The valve acceptance feature 4 is manufactured in a particularly low-cost manner by deep drawing a sheet-metal blank, whereas the fuel supply passage 2 is manufactured from a pipe obtainable as a commercial profiled semi-finished product of, for example, rectangular cross-section.

On their ends facing away from the induction pipe 8, each of the valve acceptance features 4 has a collar 51, which is open in the direction of the connection end 10 of the injection valve 3 and which consists of a radially extending part 53 and a cylindrical part 54 following on from it. The radially extending part 53 of the collar 51 is followed in the direction of the spray opening 17 of the inserted injection valve 3 by a first cylindrical section 65 which is separated from a second cylindrical section 66 having a smaller diameter than the first sections 65 by a step 67, which is in contact with the inside of the wall of the fuel supply passage 2 and fixes the valve acceptance feature 4 in its axial position. The valve acceptance feature 4 is inserted in the fuel supply passage 2 in two coaxial holes 68, 69 whose diameters correspond to the external diameters of the cylindrical sections 65, 66 and is connected in a sealed manner to the fuel supply passage 2 by soldering, brazing or welding, for example. Sealing to the induction pipe 8 takes place by means of a sealing element 73, for example by means of a rubber preform.

Figure 3:
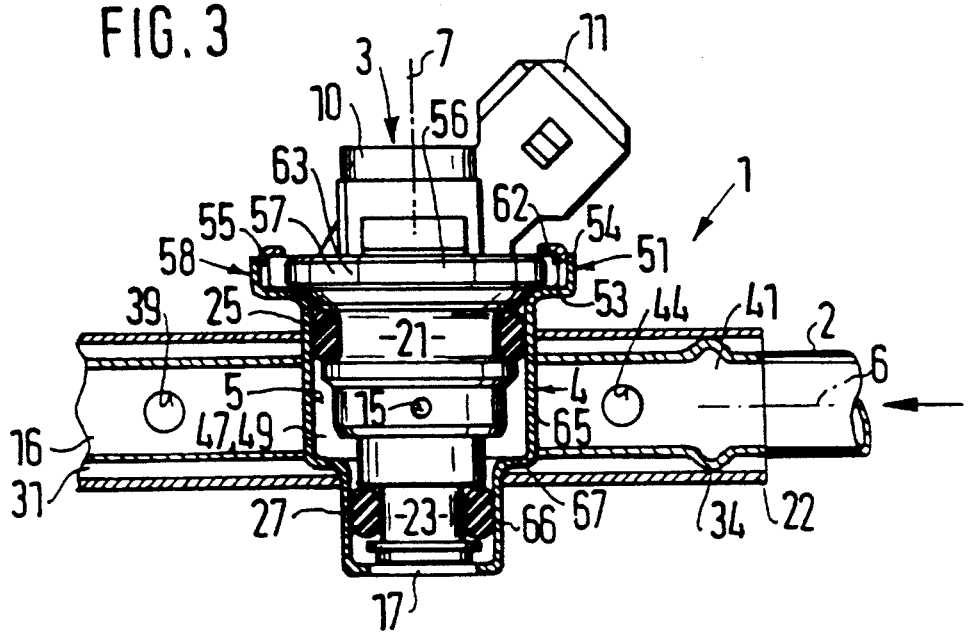
Figure 4:
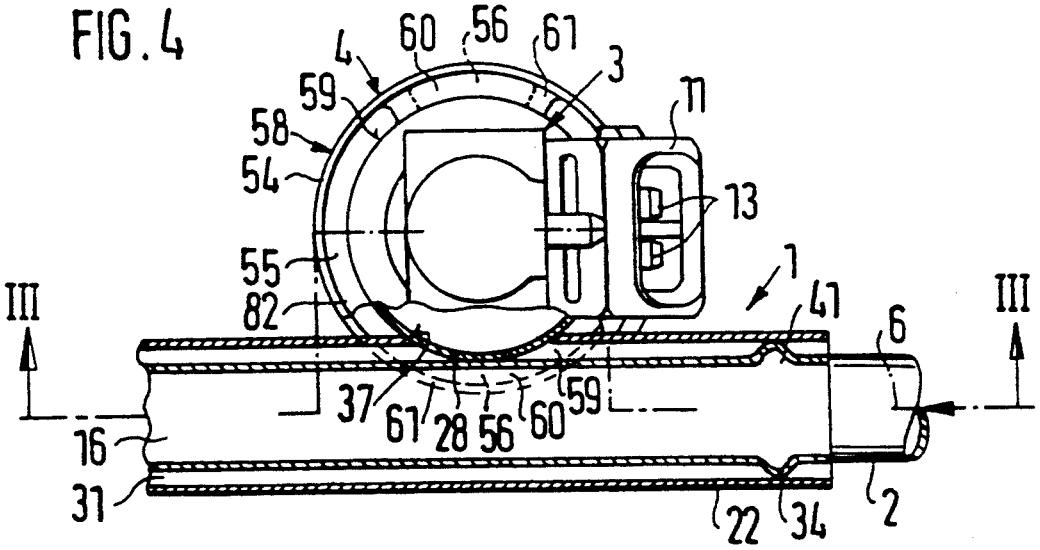

A second embodiment example according to the invention is shown in FIGS. 3 and 4 of the drawing, the components acting in the same way and remaining the same relative to the embodiment example of FIGS. 1 and 2 being designated by the same reference signs.

The fuel supply passage 2 is surrounded, at a distance, by an outer tube 22 of, for example, circular cross-section so that an annular cross-section 31 is formed between the outer tube 22 and the fuel supply passage 2. The annular cross-section 31 is in connection with the reservoir volume 47 bounded by the periphery of the fuel injection valve 3 and the respective wall of the valve acceptance feature 4 by means, for example of, an opening 37 arranged in the outer tube 22 and at least one fuel supply opening 28 of the valve acceptance feature 4 overlapping the opening 37.

The fuel supply passage 2 is held as a press fit (and sealed by soldering, for example) in its position in the outer tube 22 by means of two lips 34, for example beads, extending radially beyond the periphery and respectively located in the region of one end 41 of the fuel distributor 1. These lips are produced by internal rolling in the fuel supply passage 2 and have a larger diameter before assembly than the internal diameter of the outer tube 22 [sic]. An opposite arrangement in which the lips are arranged on the outer tube is also possible.

The annular cross-section 31 is used to form a fuel reservoir free from vapour bubbles. The flow cross-section 16 is in connection with the annular cross-section 31 by means of at least one connecting opening 39 passing through the wall of the fuel supply passage 2. The main fuel flow scavenging the fuel distributor 1 flushes through the flow cross-section 16 to cool the fuel injection valves 3 and the fuel distributor 1 and only flows separately past the annular cross-section 31 because of the wall of the fuel supply passage 2. Only a small part of the fuel flowing through the flow cross-section 16 reaches the annular cross-section 31 through the at least one connecting opening 39 and replaces the fuel ejected from the latter by the fuel injection valves 3. The connecting opening 39 can be located in the centre but also at a different position of the fuel supply passage 2.

In addition, connecting openings 44 are provided in the region of the two ends 41 of the fuel supply passage 2. These openings 44 make a connection between the annular cross-section 31 and the flow cross-section 16 and are used to vent the annular cross-section 31 used as a fuel reservoir. In addition to permitting a fuel exchange between the flow cross-section 16 and the annular cross-section 31, the vent openings 44 also make it possible for vapour bubbles to pass across from the annular cross-section 31 into the flow cross-section 16.

The annular cross-section 31 used as the fuel reservoir and the individual reservoir volume 47 surrounding the respective fuel injection valve 3 jointly form the thick juice reservoir 49 in which vapour-free, i.e. liquid, fuel can collect after the warm internal combustion engine, equipped with the fuel distributor 1 according to the invention, has been shut down and which permits hot starting of the internal combustion engine without difficulty. The fuel reservoir, of the thick juice volume 49, formed by the annular cross-section 31 is particularly well cooled by the fuel flushing through the flow cross-section 16 of the fuel distributor 1 because of the large surface of the fuel supply passage 2 separating the flow cross-section 16 and the annular cross-section 31.

In both embodiment examples, the connection between the injection valves 3 and the valve acceptance feature 4 is made by means of either a bayonet connection or by a clip connection.

In order to configure a clip connection, as shown in FIGS. 1 and 2 of the drawing, a flange 50, which is configured above the annular groove 21 on the fuel injection valve 3, whose diameter corresponds to the internal diameter of the cylindrical part 54 of the collar 51 and whose thickness is slightly larger than the axial extent of the cylindrical part 54 of the collar 51, engages in the collar 51 so that the flange 50 can be introduced into the collar 51 along the acceptance feature longitudinal axis 7 in the direction of the induction pipe 8.

The flange 50 and the collar 51 are encompassed by a clip 52 of U-shaped profile. The distance, pointing in the direction of the acceptance feature longitudinal axis 7, between the two arms 79, 80 of the clip 52 is dimensioned in such a way that one arm 79 is in contact with the flange 50 of the injection valve 3 whereas the other arm 80 is in contact with the radially extending part 53 of the collar 51 so that the flange 50, and therefore the injection valve 3, is firmly clamped in the collar 51 of the valve acceptance feature 4 and is fixed in both its axial and rotational position. The periphery of the clip 52 can be adjusted by means of a screw 81. For assembly purposes, the periphery of the clip 52 is increased in such a way that it can be guided over the collar 51 of the valve acceptance feature 4. In order to fasten the injection valve 3 in the valve acceptance feature 4, the periphery of the clip 52 is reduced by rotating the screw 81 until it is in firm contact with the collar 51 and the flange 50.

Figure 5:
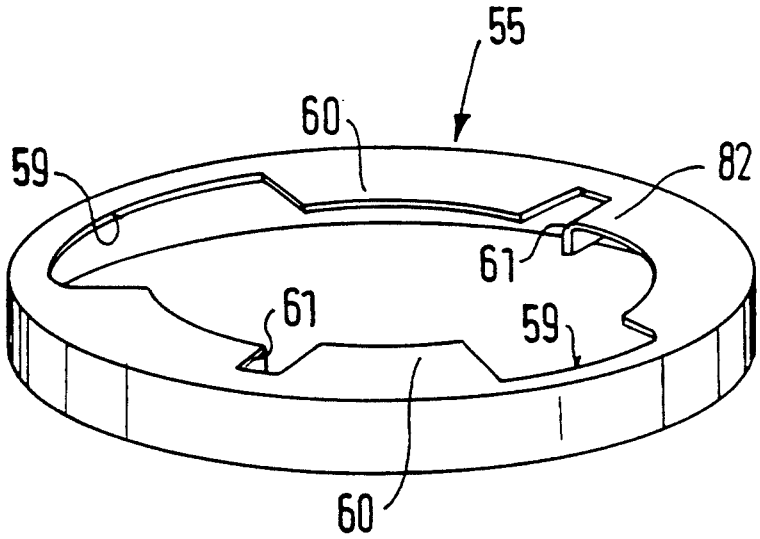

In order to fasten the injection valve 3 in the valve acceptance feature 4 by means of a bayonet connection, as shown in FIGS. 3 and 4 of the drawing, a bayonet socket 55 encompassing the valve acceptance feature 4 is provided at its end facing towards the connection end 10 of the fuel injection valve 3. This bayonet socket 55, which is shown more clearly in FIG. 5 of the drawing, is fitted into the collar 51 of the valve acceptance feature 4 and is firmly connected to the latter, for example by soldering, so that an annular space 62 open towards the acceptance feature longitudinal axis 7 is formed. Above the annular groove 21, the fuel injection valve 3 has an end flange 63 configured as a bayonet insert 57, which end flange 63 consists of two diametrically opposite bayonet tabs 56 which can be axially introduced into the annular space 62 through two recesses 59. The bayonet insert 57, together with the bayonet socket 55, forms a bayonet fastening 58.

The two recesses 59 are followed in the peripheral direction by two overlap pieces 60 which pass over the bayonet tabs 56 after rotation of the bayonet tabs 56 of the bayonet insert 57 in the recesses 59. There is a stop 61 for the bayonet tabs 56 at the end of each of the overlap pieces 60. The stops 61 determine the rotational position of the fuel injection valve 3 in the valve acceptance feature 4 and, therefore, the injection direction of the fuel injection valve 3. They are produced by bending over corresponding pieces from the radially extending part 82 at right angles to the latter in the direction facing away from the connection end 10. The width of the bayonet tabs 56 measured in the peripheral direction of the bayonet tabs 56 is dimensioned with respect to the position of the stops 61 in such a way that when the bayonet tabs 56 are in contact with the stops 61, the bayonet tabs 56 are completely covered by the overlap pieces 60. The use of the easily manufactured fuel distributor 1, according to the invention, in an internal combustion engine permits fuel free from vapour bubbles to be sprayed in the first few seconds after a hot start of the internal combustion engine because of the formation of a fuel reservoir with fuel free from vapour bubbles so that the hot start properties are markedly improved. The fixing of the fuel injection valve 3 on the fuel distributor 1 by means of a bayonet fastening 58 permits rapid assembly and assured positioning.

I claim:

1. A fuel distributor of fuel injection systems of internal combustion engines for a fuel supply of at least two fuel injection valves, having a number of stepped valve acceptance features corresponding to the number of fuel injection valves, each valve acceptance feature having a valve acceptance opening which is in connection with a flow passage of a fuel supply passage via at least one fuel supply opening provided in each valve acceptance feature and into which valve acceptance openings fuel injection valves are insertable in such a way that the valve acceptance features at least partially surround the fuel injection valves, fuel flowing through a flow cross-section (16) flows around each valve acceptance feature (4) on all sides in a section penetrating the fuel supply passage (2) and at least one fuel supply opening (28) of each valve acceptance feature (4) is arranged on a side of the valve acceptance feature (4) at right angles to the flow direction or facing away from the flow direction.

2. A fuel distributor according to claim 1, in which the fuel distributor (1) has one stepped-down screw acceptance feature (12), which penetrates through the fuel supply passage (2).

3. A fuel distributor according to claim 2, in which an end flange (63) of the fuel injection valve (3) is configured as a bayonet insert (57) and a collar (51) of the valve acceptance feature (4) is configured as a bayonet socket (55), corresponding to the bayonet insert (57), of a bayonet fastening (58).

4. A fuel distributor according to claim 3, in which at least one stop (61) for the bayonet insert (57) is provided in the bayonet socket (55), which stop (61) is arranged in such a way that when the bayonet insert (57) is in contact with said stop, the fuel injection valve (3) takes up a predetermined position which determines the injection direction.

5. A fuel distributor according to claim 2, in which the valve acceptance feature (4) has a collar (51) on an end facing away from the induction pipe (8), a flange (50) of the fuel injection valve (3) engaging in this collar (51) and the flange (50) and the collar (51) being encompassed by a clip (52) of U-shaped profile.

6. A fuel distributor according to claim 3, in which the valve acceptance feature (4) has a collar (51) on an end facing away from the induction pipe (8), a flange (50) of the fuel injection valve (3) engaging in this collar (51) and the flange (50) and the collar (51) being encompassed by a clip (52) of U-shaped profile.

7. A fuel distributor according to claim 1, in which an end flange (63) of the fuel injection valve (3) is configured as a bayonet insert (57) and a collar (51) of the valve acceptance feature (4) is configured as a bayonet socket (55), corresponding to the bayonet insert (57), of a bayonet fastening (58).

8. A fuel distributor according to claim 7, in which at least one stop (61) for the bayonet insert (57) is provided in the bayonet socket (55), which stop (61) is arranged in such a way that when the bayonet insert (57) is in contact with said stop, the fuel injection valve (3) takes up a predetermined position which determines the injection direction.

9. A fuel distributor according to claim 7, in which the valve acceptance feature (4) has a collar (51) on an end facing away from the induction pipe (8), a flange (50) of the fuel injection valve (3) engaging in this collar (51) and the flange (50) and the collar (51) being encompassed by a clip (52) of U-shaped profile.

10. A fuel distributor according to claim 1, in which the valve acceptance feature (4) has a collar (51) on an end facing away from the induction pipe (8), a flange (50) of the fuel injection valve (3) engaging in this collar (51) and the flange (50) and the collar (51) being encompassed by a clip (52) of U-shaped profile.

11. A fuel distributor for fuel injection systems of internal combustion engines for the fuel supply of at least two fuel injection valves, having a number of stepped valve acceptance features corresponding to the number of fuel injection valves, each valve acceptance feature having a valve acceptance opening which is in connection with a flow passage of a fuel supply passage via at least one fuel supply opening and into which valve acceptance openings the fuel injection valves are insertable in such a way that the valve acceptance features at least partially surround the fuel injection valves, the fuel distributor (1) has an outer tube (22) which surrounds, at a distance, a fuel supply passage (2) configured as a tube and surrounds an annular cross-section (31) formed between the outer tube (22) and the fuel supply passage (2), the annular cross-section (31) being connected by at least one connecting opening (37, 44) to the flow cross-section (16) and each valve acceptance feature (4) being connected to the annular cross-section (31) by at least one fuel supply opening (28).

12. A fuel distributor according to claim 11, in which an end flange (63) of the fuel injection valve (3) is configured as a bayonet insert (57) and a collar (51) of the valve acceptance feature (4) is configured as a bayonet socket (55), corresponding to the bayonet insert (57), of a bayonet fastening (58).

13. A fuel distributor according to claim 12, in which at least one stop (61) for the bayonet insert (57) is provided in the bayonet socket (55), which stop (61) is arranged in such a way that when the bayonet insert (57) is in contact with said stop, the fuel injection valve (3) takes up a predetermined position which determines the injection direction.

14. A fuel distributor according to claim 12, in which the valve acceptance feature (4) has a collar (51) on an end facing away from the induction pip (8), a flange (50) of the fuel injection valve (3) engaging in this collar (51) and the flange (50) and the collar (51) being encompassed by a clip (52) of U-shaped profile.

15. A fuel distributor according to claim 11, in which the valve acceptance feature (4) has a collar (51) on an end facing away from the induction pipe (8), a flange (50) of the fuel injection valve (3) engaging in this collar (51) and the flange (50) and the collar (51) being encompassed by a clip (52) of U-shaped profile.

* * * * *